US005261846A

United States Patent [19]

Hanna

[11] Patent Number: 5,261,846

[45] Date of Patent: Nov. 16, 1993

[54] FLEXIBLE FLYING DISK TOY

[75] Inventor: Thomas Hanna, Wichita, Kans.

[73] Assignee: Rose American Corporation, Wichita, Kans.

[21] Appl. No.: 958,776

[22] Filed: Oct. 9, 1992

[51] Int. Cl.[5] ..... A63H 27/00

[52] U.S. Cl. ..... 446/46

[58] Field of Search ..... 446/46–48, 446/236; 273/424, 425

[56] References Cited

U.S. PATENT DOCUMENTS

| | | | |
|---|---|---|---|
| 82,425 | 9/1868 | Lucey . | |
| 256,227 | 4/1882 | Ligowsky | 273/424 X |
| 1,962,927 | 5/1931 | De Bats | 273/424 X |
| 2,804,123 | 8/1957 | Kling | 273/424 X |
| 2,984,937 | 5/1961 | Rendon . | |
| 3,026,110 | 11/1969 | Hess et al. | 273/424 |
| 3,852,910 | 12/1974 | Everett | 446/46 |
| 3,935,668 | 2/1976 | Phillips, Jr. | 446/450 |
| 3,948,523 | 4/1976 | Michael | 446/47 X |
| 4,115,946 | 9/1978 | Vukmirovich | 446/46 |
| 4,157,631 | 6/1979 | Kifferstein et al. | 446/46 |
| 4,201,009 | 5/1980 | Burridge, Jr. | 446/46 |
| 4,223,473 | 9/1980 | Brown | 446/46 |
| 4,241,533 | 12/1980 | Newsome | 446/46 |
| 4,253,672 | 3/1981 | Milzoff et al. | 273/42 X |
| 4,290,226 | 9/1981 | Stauffer | 446/46 |
| 4,335,536 | 6/1982 | Magid et al. | 446/46 |
| 4,357,020 | 11/1982 | Van Bryant, Jr. | 273/424 |
| 4,709,928 | 12/1987 | Willingham | 273/424 X |
| 5,078,637 | 1/1992 | McFarland | 446/46 |

FOREIGN PATENT DOCUMENTS

| | | | |
|---|---|---|---|
| 1400474 | 6/1975 | United Kingdom | 446/46 |
| 2076671 | 12/1981 | United Kingdom | 446/46 |

*Primary Examiner*—Mickey Yu

*Attorney, Agent, or Firm*—Shoemaker and Mattare

[57] ABSTRACT

A flexible flying disk toy includes a central circular section formed from a single piece of synthetic fabric having a peripheral edge, and a rim connected to the edge. The rim is formed by joining together the ends of a length of hollow vinyl tubing which is covered with a tubular synthetic webbing whose ends are joined together to retain the hollow tubing therein. The tubular webbing is sewn to the central section along a circumferential fold in the webbing.

3 Claims, 2 Drawing Sheets

FLEXIBLE FLYING DISK TOY

BACKGROUND OF THE INVENTION

This invention relates to throwing toys, especially to an improved flexible flying disk made of fabric.

"Flying disk toy" is a term generic to devices best known by the trademark "Frisbee". Many dogs enjoy retrieving these toys. The standard molded plastic Frisbee, however, has some disadvantages as a pet toy. Its relatively hard material may injure a dog's mouth, and it cannot be safely thrown in crowded areas. And, while it retains its aerodynamic shape well, it cannot be folded for storage in a pocket or glove compartment.

Therefore, prior inventors have proposed softer, more flexible toys of this type. Many are made of a fabric, which can be easily folded. They typically have a rim that provides some stiffness, but can be bent without damage. The rim may comprise a foam core, a rubber tube, or other reinforcement.

In 1962, Hess et al. were issued a patent (U.S. Pat. No. 3,026,110) disclosing a disk-shaped projectile made of fabric filled with a soft wadding material. The periphery bead of the projectile was made by folding a single piece of material in a U-shape around wadding material, and then sewing the edges of that piece to upper and lower circular sections forming the center of the toy.

Milzoff et al. received U.S. Pat. No. 4,253,672 in 1981. Again, that device had a separate piece of cloth at its periphery, sewn to top and bottom fabric pieces; however, the core material was a foam rubber.

Newsome's U.S. Pat. No. 4,241,533 disclosed a disk having a central section formed from a single piece of material, bounded by a periphery comprising a foam rod contained within a fabric retainer whose edges were sewn to either side of the central section.

The Patent and Trademark Office has issued a substantial number of other patents for flexible flying disk

SUMMARY OF THE INVENTION

An object of the invention is to produce a safe, strong and economical flying disk toy particularly suited for play with pets.

Another object of the invention is to render such a toy both flexible and aerodynamic.

A further object is to improve the flotation of a flying disk toy, so that it can be used in and near water.

These and other objects are attained by a flexible flying disk toy includes a central circular section formed from a single piece of synthetic fabric having a peripheral edge, and a rim connected to the edge. The rim is formed by joining together the ends of a length of resilient, hollow tubing which is covered with a tubular synthetic webbing whose ends are joined together to retain the hollow tubing therein. The tubular webbing is sewn to the central section along a circumferential flange produced by stitching the webbing.

BRIEF DESCRIPTION OF THE DRAWINGS

In the accompanying drawings.

DESCRIPTION OF THE PREFERRED EMBODIMENT

Figure 1:
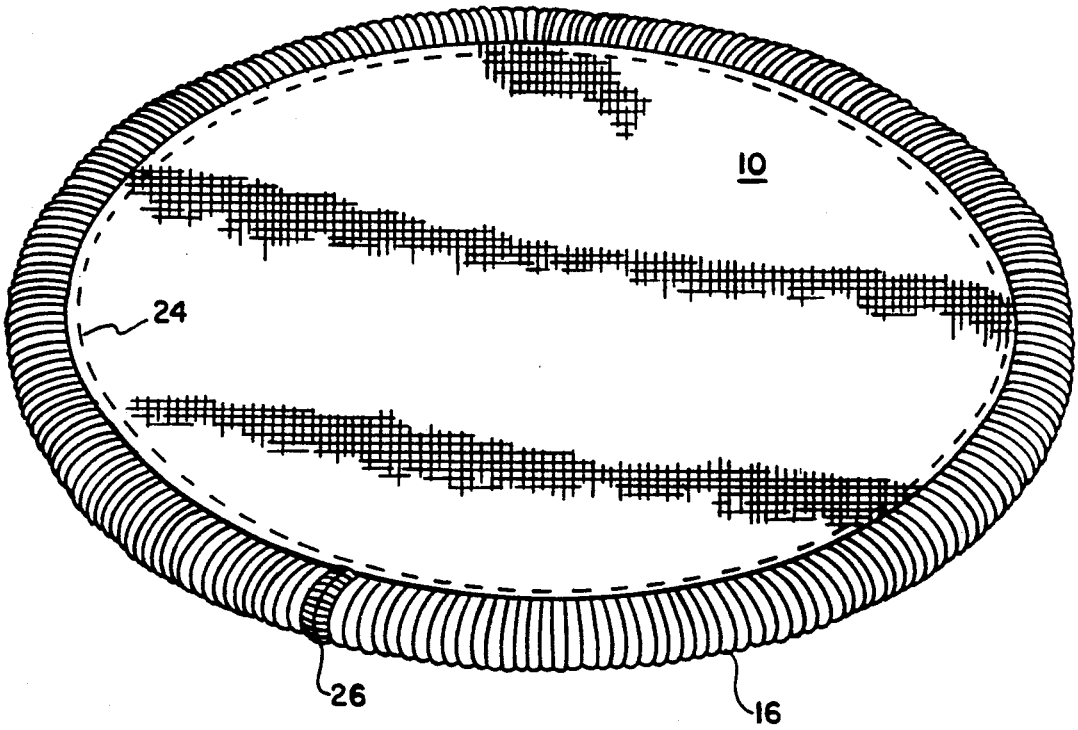
FIG. 1 is a perspective view of a flexible flying disk toy embodying the invention, as viewed from above.
Figure 2:
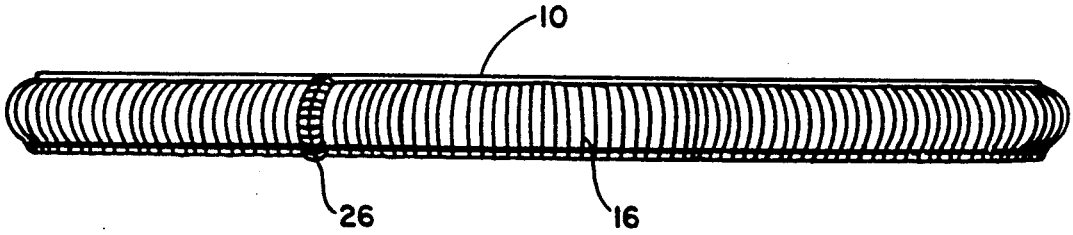
FIG. 2 is a side elevation thereof.
Figure 3:
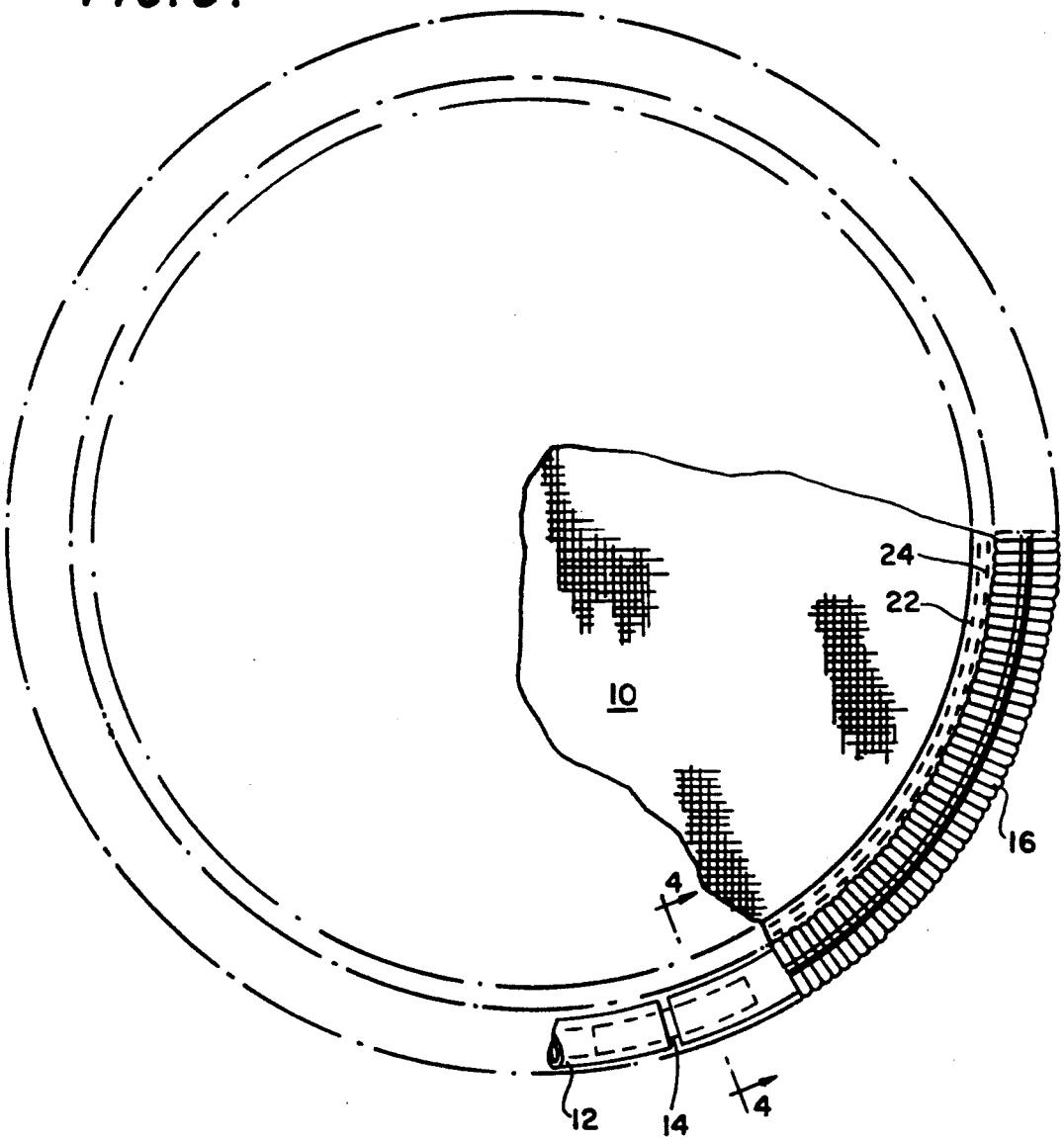
FIG. 3 is a bottom plan view thereof, with unnecessary detail omitted.
Figure 4:
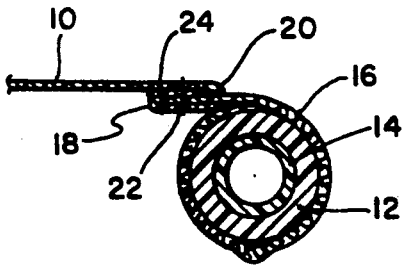
FIG. 4 is a sectional view taken along the line 4—4 in FIG. 3.

The invention is embodied in the flexible flying disk toy illustrated in FIGS. 1–4. The toy comprises a central, circular section 10 made of a single layer of tear-resistant synthetic fabric. We presently prefer to use a 400 or 420 Dernier coated nylon packcloth, which is available from a number of sources including Brookwood Roll Goods, New York, N.Y. and Performance Fabrics, Denver, Colo.

The rim of the toy comprises a core constructed from resilient transparent vinyl tubing 12 having a half-inch outside diameter, and a quarter-inch inside diameter. Such tubing is obtainable from Cope Plastics, Topeka, Kans. Its ends are interconnected by a plastic tubing connector 14, one source of which is B. J. Alberts Company, Inc, Wichita, Kans. The core is covered by tubular nylon webbing material 16, obtainable from California Webbing, Los Angeles, Calif. This material has no lateral edges, being woven in tubular form. Its inside diameter is somewhat greater than the outside diameter of the vinyl tubing, to provide a portion 18 which can be sewn to the periphery 20 of the central section, as described below.

A preferred method of making the device is as follows.

A piece of the tubular webbing, equal in length to the circumference of the circular section, is folded flat, so that two folded edges result. A line of stitching 22 is placed along one side of the webbing, about 0.2 inch from and parallel to one of the folded edges. This stitching defines a flange portion 18 which is then sewn to the folded-over periphery 20 of the central section with a second line of stitching 24 somewhat closer to the edge.

A piece of the plastic tubing 12, equal in length to that of the tubular webbing, is fully inserted into the webbing. Now, the exposed ends of the plastic tubing are joined by inserting the connector 14 into them. The connector hermetically seals the ends of the tube, so that water cannot enter; consequently, the toy will float if it lands in water. The tubular webbing 14 is then closed around the plastic tubing, by sewing the webbing's ends together with stitching 26.

Since the invention is subject to modifications and variations, it is intended that the foregoing description and the accompanying drawings shall be interpreted as illustrative of only one form of the invention, whose scope is to be measured by the following claims.

I claim:

1. A flexible flying disk toy comprising a central circular section formed from a single piece of synthetic fabric having a peripheral edge, and a rim connected to said edge, said rim comprising a length of resilient, hollow tubing having two ends joined by a connector which hermetically seals the tube so that water cannot enter the tube, and a length of seamless tubular fabric webbing having two ends joined together to retain the hollow tubing therein, said webbing having a fold defining an inner circumferential flange stitched to the peripheral edge of said central section.

2. The invention of claim 1, wherein said peripheral edge of said circular section is folded over downward to form a folded edge which is sewn to the top of said fold, whereby the peripheral edge of the circular section is offset above said rim.

3. A method of making a flying disk toy, comprising steps of forming a circular piece of synthetic fabric, sewing a length of seamless tubular fabric webbing along the entire periphery of the circular piece, inserting a like length of hollow plastic tubing into the tubular fabric webbing, interconnecting the ends of the hollow tubing to form a circular rim, and then sewing the ends of the tubular fabric webbing together around the hollow tubing.

* * * * *